US010709301B2

(12) United States Patent
Rickert

(10) Patent No.: US 10,709,301 B2
(45) Date of Patent: Jul. 14, 2020

(54) TUBE, REUSABLE INSERT FOR TOILET ROLLS

(71) Applicant: Russell Leon Rickert, Milmont Park, PA (US)

(72) Inventor: Russell Leon Rickert, Milmont Park, PA (US)

( * ) Notice: Subject to any disclaimer, the term of this patent is extended or adjusted under 35 U.S.C. 154(b) by 122 days.

(21) Appl. No.: 15/641,663

(22) Filed: Jul. 5, 2017

(65) Prior Publication Data

US 2018/0014700 A1 Jan. 18, 2018

Related U.S. Application Data

(60) Provisional application No. 62/493,757, filed on Jul. 14, 2016.

(51) Int. Cl.

| | |
|---|---|
| ***A47K 10/22*** | (2006.01) |
| ***A47K 10/16*** | (2006.01) |
| ***A47K 10/32*** | (2006.01) |
| ***A47K 10/40*** | (2006.01) |

(52) U.S. Cl.
CPC ..... *A47K 10/22* (2013.01); *A47K 10/16* (2013.01); *A47K 10/40* (2013.01); *A47K 2010/3206* (2013.01)

(58) Field of Classification Search
CPC ..... A47K 10/22; A47K 10/16; A47K 10/40; A47K 2010/3206; B65H 75/02; B65H 75/18
See application file for complete search history.

(56) References Cited

U.S. PATENT DOCUMENTS

| | | | | | |
|---|---|---|---|---|---|
| 1,817,897 | A * | 8/1931 | Johnson | A47K 10/38 | 242/410 |
| 2,563,148 | A * | 8/1951 | Zeller | G03B 21/321 | 242/336 |
| 2,571,321 | A * | 10/1951 | Wettley | A47K 10/32 | 242/599.4 |
| 2,616,631 | A * | 11/1952 | Bauer | B65H 16/06 | 242/573 |
| 2,699,903 | A * | 1/1955 | Montgomery | A47K 10/38 | 242/422.4 |
| 2,876,960 | A * | 3/1959 | Glaner | A47K 10/22 | 242/599.1 |
| 2,879,010 | A * | 3/1959 | Crawford | B65H 75/18 | 242/118.32 |

(Continued)

FOREIGN PATENT DOCUMENTS

WO 2015176085 A1 11/2015

OTHER PUBLICATIONS

Reusable Toilet Paper Tubes, CRESBI Crate, Sun Sugar Farms, Accessed on Apr. 7, 2017, https://www.cresbicrate.com/TUBELESS.

*Primary Examiner* — William A. Rivera
(74) *Attorney, Agent, or Firm* — Schott, P.C.

(57) ABSTRACT

A reusable insert for a tubeless roll of material, such as a toilet paper roll, which insert coordinates with a standard spindle, roller axle or toilet paper roll holder, such that the material can spin freely, and is secure and centered on the spindle or axle, the insert having a tapered, hollow end, a tubular, hollow body and, distal from the tapered end, a cylindrical, hollow sleeve within the inner surface of the distal part of the tubular hollow body, where the hollow sleeve acts as a bearing to the roller axle.

18 Claims, 4 Drawing Sheets

(56) References Cited

U.S. PATENT DOCUMENTS

| | | | | | |
|---|---|---|---|---|---|
| 3,000,590 | A * | 9/1961 | Dunlap | B65H 75/18 | 242/118.31 |
| 3,315,906 | A * | 4/1967 | Storey | D02H 13/28 | 242/118.6 |
| 3,436,034 | A * | 4/1969 | Crawford | B65H 75/18 | 242/118.32 |
| 4,234,134 | A * | 11/1980 | Rhine | B65H 23/06 | 242/423.1 |
| 5,100,075 | A * | 3/1992 | Morand | A47K 10/3836 | 206/389 |
| 5,125,586 | A * | 6/1992 | Whitethorn | A47K 10/3836 | 242/573.9 |
| 5,370,336 | A * | 12/1994 | Whittington | A47K 10/3836 | 242/560.2 |
| 5,669,576 | A | 9/1997 | Moody | | |
| 7,568,653 | B2 | 8/2009 | Zeiron | | |
| D703,461 | S | 4/2014 | Myron | | |
| 8,783,600 | B1 | 7/2014 | Myron | | |
| 9,227,281 | B1 | 1/2016 | Meadows | | |
| 2006/0175459 | A1 * | 8/2006 | Hua | B65H 75/245 | 242/571.7 |
| 2009/0057169 | A1 | 3/2009 | Kruchoski et al. | | |
| 2011/0210199 | A1 | 9/2011 | Sinsabaugh | | |
| 2015/0090835 | A1 | 4/2015 | Toussaint | | |

* cited by examiner

TUBE, REUSABLE INSERT FOR TOILET ROLLS

BACKGROUND

In recent years, numerous manufacturers of toilet paper products have recognized the need to develop new manufacturing methods and designs to help save the environment from unnecessary pollution. One method used has been to eliminate the mountains of unnecessary paper waste generated through their historical practice of winding the toilet paper over disposal cardboard tubes. The disposal of these cardboard tubes on the worldwide scale is enormous, with literally millions of tubes being discarded every hour of the day into landfills and the like on the worldwide stage. For this reason, there developed a need for tubeless toilet paper rolls, and tubeless rolls of other web material. Use of these tubeless rolls, however, has been met with resistance because of certain differences in the appearance, function and feel of such rolls.

Tubeless rolls face challenges such as:

1) Overcoming the perception by the public that paper or material rolls need to have central tubes.

2) Overcoming people's preference for rolls with central tubes, recognizing that change is always uncomfortable and is almost always met with resistance, the insert is designed to help overcome this negative bias.

3) As shown in FIGS.7 and 8, tubeless toilet paper rolls may they have central holes that are irregular in shape, which makes it hard to insert the spring loaded central roller axle shafts (hereinafter, "roller axle') that are necessary for proper attachment to external housing 600 as shown in FIG. 5.

4) Another functional issue with the "tubeless" toilet paper rolls without central cardboard tubes for stability, is that as the roll approaches the final 10% of the paper volume, the roll will start to wobble and "collapse" before the roll is fully used and may eventually fall off the roller axle thus causing additional and unnecessary waste paper for disposal.

SUMMARY OF THE INVENTION

The reusable insert comprises a rigid, tubular, hollow body wherein a first end of the rigid, tubular, hollow body tapers to a first concentric hole, wherein the rigid, tubular, hollow body is sized to house a standard paper roller axle, and the first concentric hole is configured to be a bearing and a stop for a standard paper roller axle; and an internal bearing sleeve, the internal bearing sleeve configured to fit snugly and concentrically on an inner surface of a second end of the rigid, tubular, hollow body, the internal bearing sleeve having a second concentric hole that aligns with the first concentric hole of the tapered end.

DETAILED DESCRIPTION OF THE INVENTION

Introduction

This reusable insert for tubeless paper rolls described herein is compatible with almost all existing wall and floor mounted paper holder fixtures that use a spring loaded central roller axle to hold the toilet paper in place. The insert can be re-used without the need for maintenance or replacement under normal usage.

Furthermore, the insert is designed to also be able to use standard tube type toilet paper rolls when tubeless rolls are not available for use.

The insert offers an affordable adaptation to existing bathroom accessories that can be economical to manufacture and sell, or use as a promotional item by toilet paper manufacturers to encourage the use of their environmentally friendly tubeless toilet paper rolls by the general public without their need to acquire costly new and costly hardware.

Figure 1:
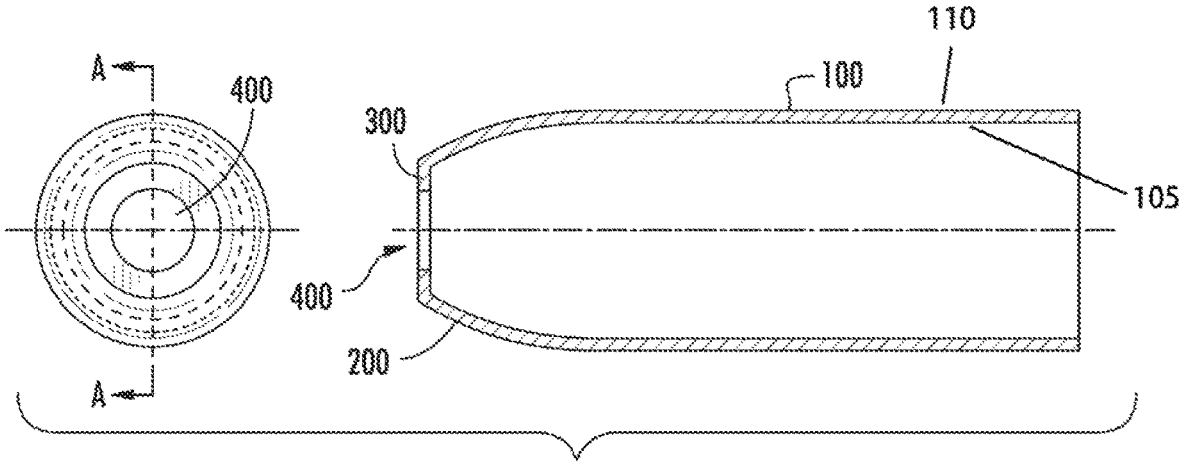
FIG. 1 illustrates the main housing of the device.
Figure 5:
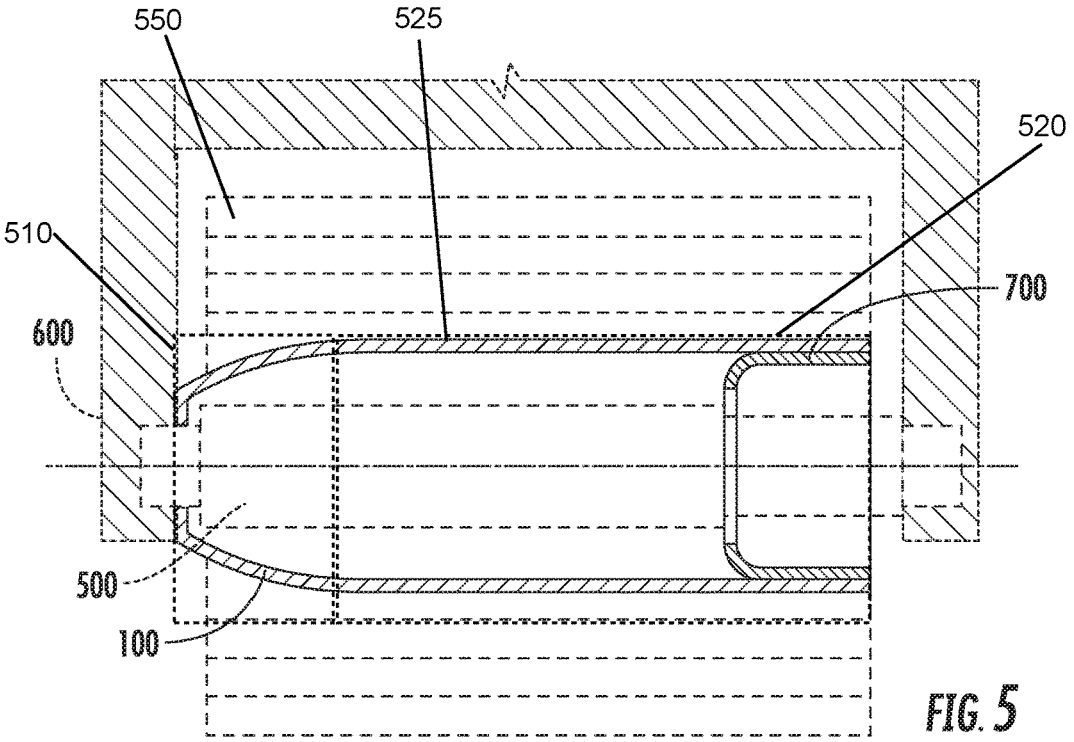
FIG. 5 illustrates the housing assembly in place for use.

The insert is an easy to use device, as there is no need for complex written instructions or multi-lingual translations as barriers for use. As illustrated in FIGS. 1 and 5, the shape of the nose or end piece alone suggests how it is inserted into the tubeless toilet paper rolls.

The insert is an ecologically friendly device because no waste is generated by its use or by using the "tubeless" toilet paper rolls.

Figure 4:
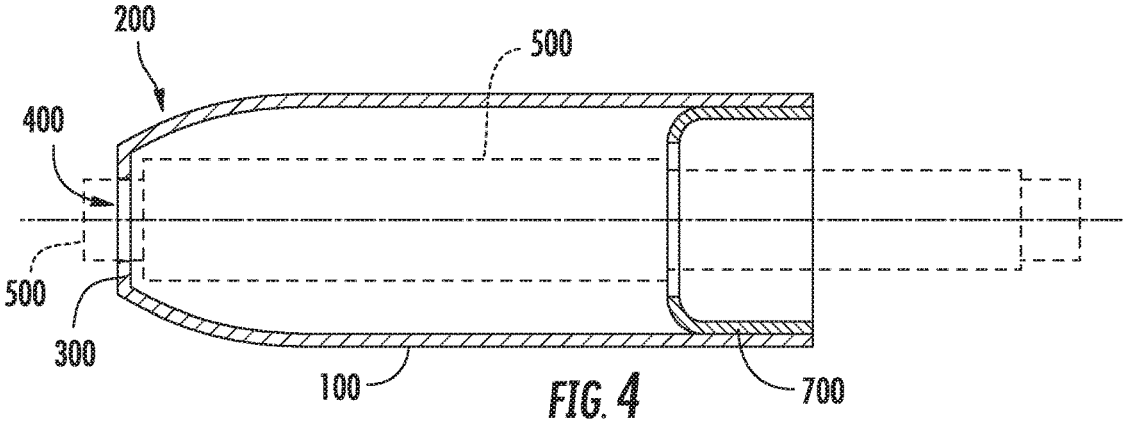
FIG. 4 illustrates the housing assembly with a standard roller axle shown.

No complex assembly or maintenance is required for the insert's use. As shown in FIGS. 4 and 5, initial set up can usually be accomplished in less than one minute into existing paper holder fixtures using the existing spring loaded central roller axles.

The insert is child friendly. No small or dangerous parts are in the design. No chance of a child ingesting any of the components.

The insert has no operating costs.

While the insert can be inexpensively formed in molded plastic, it can also be produced in other materials such as aluminum or similar materials with different design configurations, as long as the "curved shape" of the insertion end is maintained, as shown in in FIG. 1.

Description

Primarily the insert is used as a new variation of the form and function of a device for the dispensing of toilet paper or other web of material that is dispensed in a roll in consideration of the favorable environmental results that can and will result by eliminating the disposal of the existing type paper tubes as by-products.

The insert allows for the dispensing of material, for example toilet paper, from either tubeless or standard disposable tube type toilet paper rolls without the need to change existing wall mounted fixtures.

Another benefit of this insert is that it can be produced very inexpensively for mass distribution on a world-wide stage. Also, variations of the insert can be custom molded for aesthetic purposes without doing violence to its function and purpose.

The insert may be used primarily wherever rolls of material are being developed in a tubeless form, but in the case of toilet paper, in residential homes, commercial properties or business offices where indoor plumbing is common place.

Because of its design simplicity, the insert may allow for a smooth transition from toilet paper rolls with disposable core tubes to tubeless toilet paper rolls without generating buyer resistance to the perceived drastic change to such a staple product that they perceive has worked well for one hundred years or so.

This insert may also be used for primarily ecological reasons, as it helps to eliminate the massive amount of paper waste created in the United States alone by the estimated disposal of over 83 million disposable toilet roll center tubes per day, while maintaining the ease of use and feel of a standard tubed toilet paper roll. The insert may help eliminate the use of disposable cardboard type central toilet role tubes in all toilet paper rolls worldwide.

Figure 7:
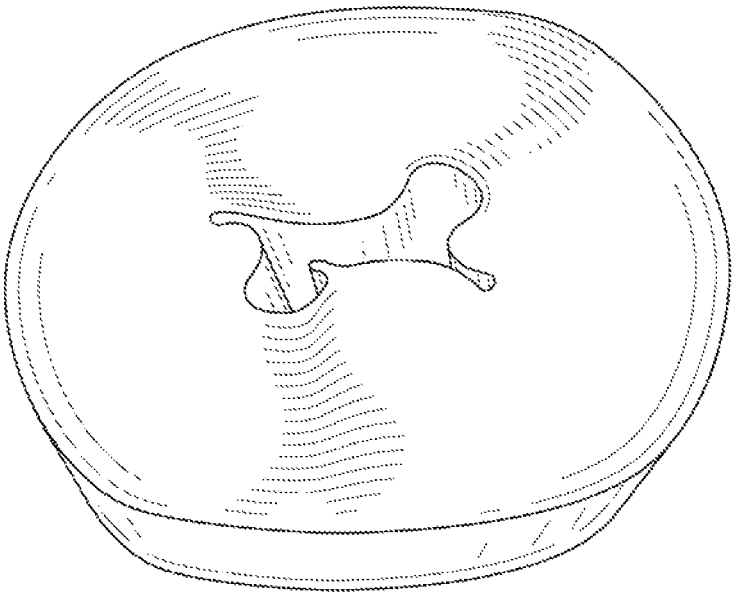
FIG. 7 illustrates a tubeless paper roll example.
Figure 8:
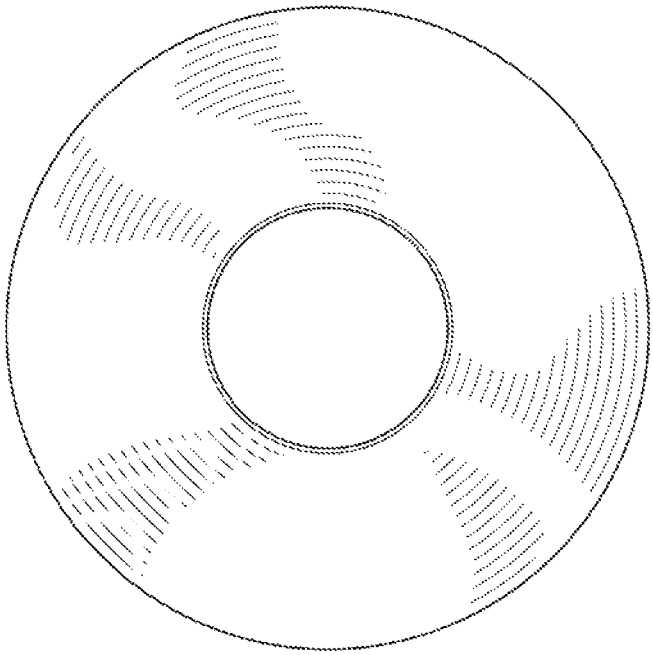
FIG. 8 illustrates a traditional disposable tube type roll example.

As showing in FIG. 7, tubeless toilet paper rolls tend to collapse. The insert is configured to be easily inserted into the roll to fix the collapsed hole. The insert is also uniquely configured to center and secure the roll during use to that it feels and functions like a standard tube-in material roll. Finally, the insert avoids the waste that tends to occur when a user gets to the end of a tubeless material roll due to the roll collapsing.

Thus, the insert may help overcome the apparent resistance by the public to accept tubeless toilet paper rolls even though they recognize the ecological value of doing the same.

The insert has been designed so that the function of the device can be easily understood by its shape without the need for detailed and complicated instructions thus eliminating voluminous translation packages when presented on a world-wide basis to civilized countries.

The insert may include two separate main parts.

As shown in FIGS. 1-4, the first part is a ridged molded plastic main housing 100 of specific and required dimensions which has a progressively tapered and shaped internal 105 and external body 110 of uniform cross section that incorporates necessary shapes for both internal and external functions. The specific internal radius which internally forms the shape of the insertion end 200 of the housing 100 also incorporates an internal stop lip 300 for the traditional paper roller axle 500 when it is inserted into the external housing assembly 600, such that the housing 100 encloses the paper roller axle 500 along its length. As shown in FIGS. 1 and 4, the internal shape of the lip 300 also acts as a front bearing and creates a first concentric hole 400, which allows the roller axle 500 to protrude through the first concentric hole 400 of the housing 100 for attachment to the external housing assembly 600. Attachment of the roller axle 500 to the external housing 600 is shown in FIG. 5.

As shown in FIGS. 4 and 5, the external shape of the housing 100 that is then formed by the uniform cross section of the housing that acts as a curved nose, or insertion end 200, of the housing 100, that is used to penetrate the irregular shaped hole of the tubeless paper rolls 550, shown in in FIG. 7, by gently spreading the opening gradually as it is inserted into the tubeless roll 550. The housing 100 includes thereby a tapered portion 510 along its length and a non-tapered portion 520, which non-tapered portion 520 contacts the roll of toilet paper 550 along the non-tapered length 520 exterior surface 525.

Figure 2:
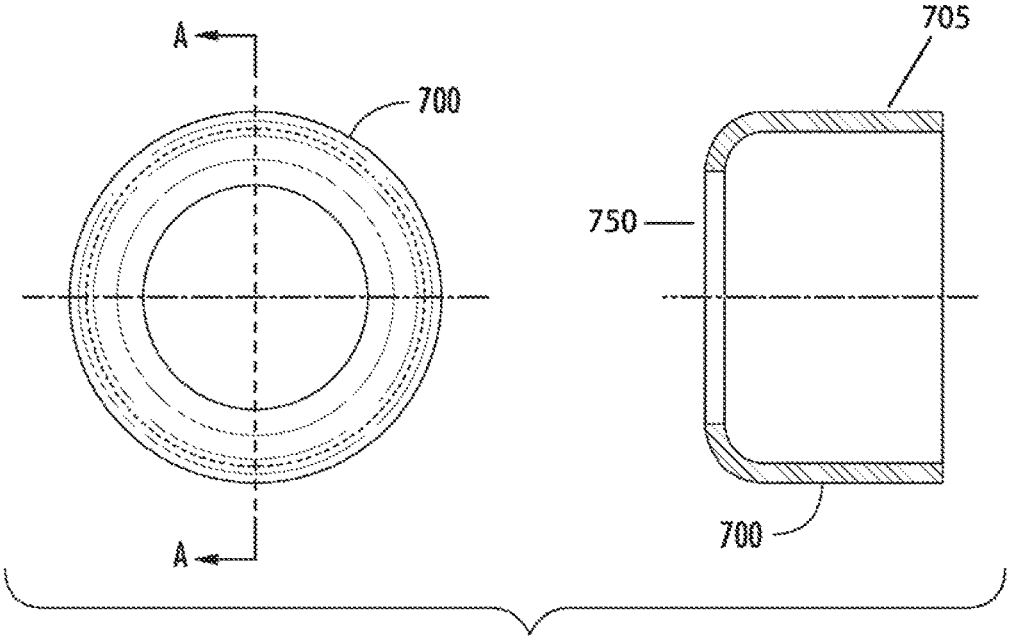
FIG. 2 illustrates the bearing insert sleeve.
Figure 3:
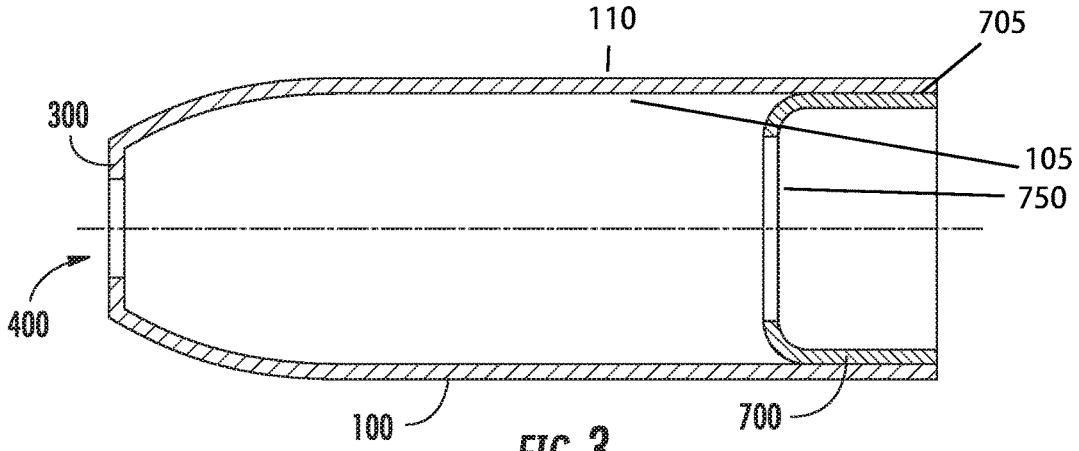
FIG. 3 illustrates a complete housing assembly.

As shown in FIG. 2, the second part of the insert, which is at the opposite end of the housing 100, contains a tapered inside diameter 105 that will match the tapered outside diameter 705 of the hearing insert sleeve 700 and is used to hold the bearing insert sleeve 700 in place after final assembly with the roller axle 500. The bearing insert sleeve 700 is a hollow, rigid body configured to fit snugly within the interior body 105 of the second end of the housing 100, and thereby forming a second concentric hole 750, which hole is aligned with the first concentric hole 400. The diameter of the second concentric hole 750 is slightly larger than the diameter of the first concentric hole 400 and slightly smaller than the diameter of the largest diameter of the insert 100. The second concentric hole 750 is configured to house the wider end of a standard toilet paper roller axle 500. The bearing insert sleeve 700 is configured to support and center the roller axle 500, and also to, in most cases, secure the roller axle 500 into a limited movement position within the housing 100, as shown in FIG. 4.

The external housing assembly 600 or fixtures, which are not part of the housing assembly 100, are usually mounted on a wall or other self-standing device and have holes the accept the round ends of the spring-loaded roller axle 500, as shown in FIG. 5.

Figure 6:
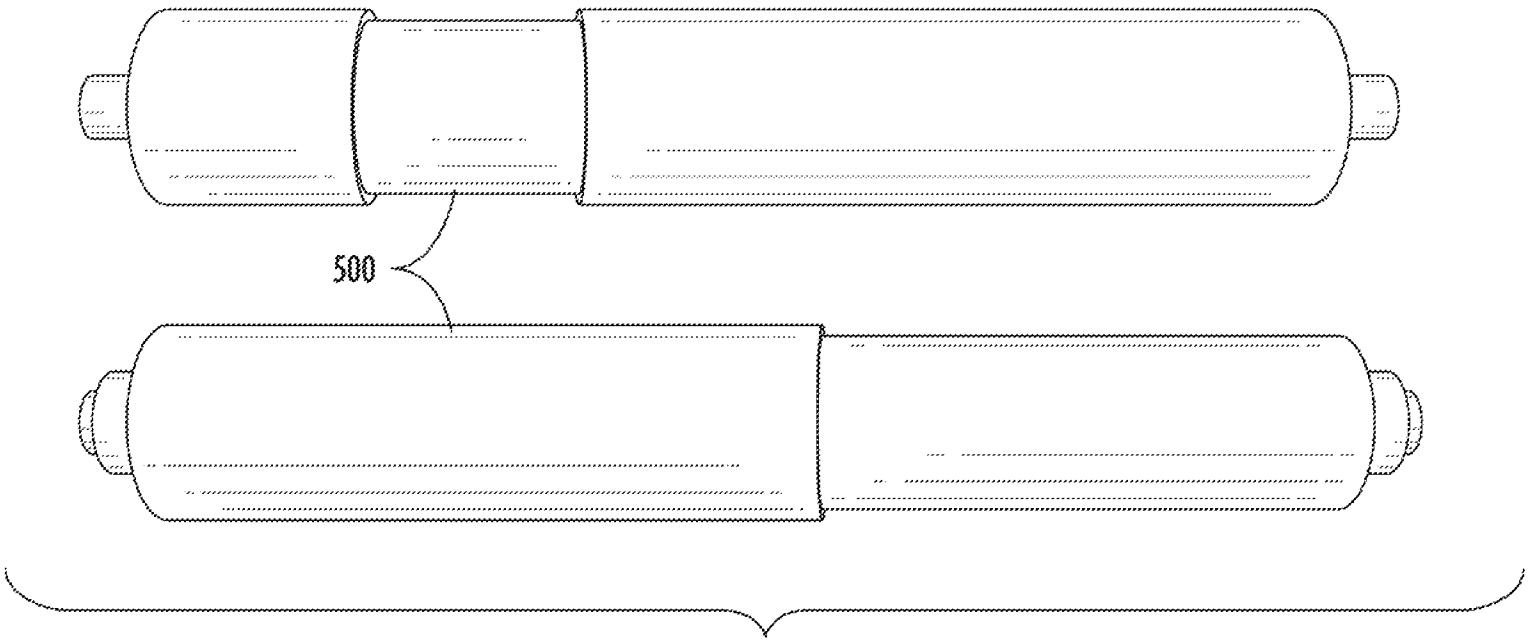
FIG. 6 illustrates most standard roller axle assemblies compatible for use.

As shown in FIG. 6, the spring-loaded roller axle 500 is interchangeable and not normally supplied. It may however be incorporated by design.

The insert 100 has specific and dimensions that have been gleaned by extensive testing of many standard roller axle assemblies with the result that the virtually all of the standard designs are compatible for use with the insert as configured. The cross-sectional area of the insert 100 may be approximately the same as or slightly larger than the cross-sectional area of a standard toilet paper roll tube, with the insertion end 200 having a cross sectional area slightly smaller than a standard toilet paper roll. The insertion end 200 of the insert 100 may have a diameter between 1.0 inches and 1.25 inches. The insertion end 200 may have a diameter of approximately 1 and ⅛ inches. The insertion end 200 may include a first concentric hole 400 that is approximately 0.75 inches in diameter. The insertion end 200 may include a first concentric hole 400 that is between approximately 0.6 inches and 0.8 inches in diameter. The insert 100 may be between approximately 4.25 inches and 4.5 inches in length. The insert 100 may be approximately 4 and ⅜ inches long. The stop lip 300 of the insert 100 may be between approximately ⅛ inches and ⅜ inches across.

The diameter of the second concentric hole 750 may be configured to act as a bearing for a standard toilet paper roller axle. The diameter of the second concentric hole 750 may be approximately 1.0 inches. The diameter of the second concentric hole 750 may be between approximately 0.9 inches and 1.1 inches.

In one embodiment, the rigid, tubular, hollow body housing 100 is comprised of plastic, metal, aluminum, polymeric or composite materials.

In one embodiment, the insertion end 200 is tapered. In one embodiment, the insertion end 200 is tapered and curved. In one embodiment, the insertion end 200 is configured to be inserted into a tubeless material roll.

In one embodiment, the material roll comprises toilet paper, paper towels, napkins, gift wrap material, fabric, tissue, plastic wrap, and/or foil wrap.

In one embodiment, a reusable insert comprising a rigid, tubular, hollow body, the hollow body having an inner surface; herein a first end of the rigid, tubular, hollow body is tapered, terminating in an inwardly directed lip and a first concentric hole, wherein the inner surface of the rigid, tubular, hollow body is sized to house a standard toilet paper roller axle, the first concentric hole is configured to be a bearing and a stop for a standard toilet paper roller axle; and an internal bearing sleeve, the internal bearing sleeve configured to fit snugly and concentrically on the inner surface of a second end of the rigid, tubular, hollow body, the internal bearing sleeve having a second concentric hole that aligns with the first concentric hole of the tapered end.

While the embodiments shown relate to tubeless toilet paper rolls, it should be understood that there will be other applications for the Invention in the context of tubeless rolls of paper or other material.

It should be understood that the foregoing relates to exemplary embodiments of the invention and that modifications may be made without departing from the spirit and scope of the invention as set forth in the following claims.

The invention claimed is:

1. A reusable insert comprising:

a rigid, tubular, hollow body defining an exterior surface, wherein a first end of the rigid, tubular, hollow body tapers to a first tapered end and a first concentric hole, wherein the rigid, tubular, hollow body is longer than a roll of toilet paper mounted thereon, wherein the rigid, tubular, hollow body is sized to house a toilet paper roller axle, wherein the rigid, tubular, hollow body is configured to enclose the toilet paper roller axle along an entire length of the rigid, tubular, hollow body, and the first concentric hole is configured to be a bearing and a stop for a toilet paper roller axle; and an internal bearing sleeve, the internal bearing sleeve configured to engage an inner surface of a second end of the rigid, tubular, hollow body, the internal bearing sleeve having a second concentric hole that aligns with the first concentric hole, wherein a diameter of the second concentric hole is configured to act as a bearing for a toilet paper roll axle.

2. The reusable insert according to claim 1, wherein the first tapered end is curved.

3. The reusable insert according to claim 1 wherein the first end is configured to be inserted into a tubeless material roll.

4. The reusable insert of claim 3 wherein the material roll is selected from a group consisting of: toilet paper, paper towels, napkins, gift wrap material, fabric, tissue, plastic wrap, and foil wrap.

5. The reusable insert according to claim 1, wherein a diameter of the first concentric hole is between 0.6 and 0.8 inches.

6. The reusable insert according to claim 1, wherein a diameter of the second concentric hole is between 0.9 inches and 1.1 inches.

7. The reusable insert according to claim 1, further comprising a roller axle configured to be coupled with the reusable insert.

8. The reusable insert according to claim 1, wherein the length of the rigid, tubular, hollow body is at least 4.25 inches and the first concentric hole is 0.75 inches in diameter.

9. The reusable insert according to claim 1, wherein the rigid, tubular, hollow body exterior surface has a non-tapered length that is configured to contact the roll of toilet paper along the non-tapered length.

10. A reusable insert comprising:

a rigid, tubular, hollow body, the hollow body having an inner surface and an exterior surface, wherein the rigid, tubular, hollow body is longer than a roll of toilet paper mounted thereon;

wherein a first end of the rigid, tubular, hollow body is tapered, terminating in an inwardly directed lip and a first concentric hole, wherein the inner surface of the rigid, tubular, hollow body houses a toilet paper roller axle wherein the rigid, tubular, hollow body encloses the toilet paper roller axle along an entire length of the rigid, tubular, hollow body, the first concentric hole that is a bearing and a stop for a toilet paper roller axle; and an internal bearing sleeve, the internal bearing sleeve that fits snugly and concentrically on the inner surface of a second end of the rigid, tubular, hollow body, the internal bearing sleeve having a second concentric hole that aligns with the first concentric hole, wherein a diameter of the second concentric hole is configured to act as a bearing for a toilet paper roll axle.

11. The reusable insert according to claim 10, wherein the first end is tapered and curved.

12. The reusable insert according to claim 10 wherein the first end is configured to be inserted into a tubeless material roll.

13. The reusable insert of claim 12 wherein the material roll is selected from a group consisting of: toilet paper, paper towels, napkins, gift wrap material, fabric, tissue, plastic wrap, and foil wrap.

14. The reusable insert according to claim 10, wherein a diameter of the first concentric hole is between 0.6 and 0.8 inches.

15. The reusable insert according to claim 10, wherein a diameter of the second concentric hole is between 0.9 inches and 1.1 inches.

16. The reusable insert according to claim 10, further comprising a roller axle configured to be coupled with the reusable insert.

17. The reusable insert according to claim 10, wherein the length of the rigid, tubular, hollow body is at least 4.25 inches and the first concentric hole is 0.75 inches in diameter.

18. The reusable insert according to claim 10, wherein the rigid, tubular, hollow body exterior surface has a non-tapered length that is configured to contact the roll of toilet paper along the non-tapered length.

* * * * *